US009300044B2

(12) United States Patent
Rogers et al.

(10) Patent No.: US 9,300,044 B2
(45) Date of Patent: Mar. 29, 2016

(54) METHODS FOR RF CONNECTIONS IN CONCENTRIC FEEDS

(71) Applicant: Honeywell International Inc., Morristown, NJ (US)

(72) Inventors: Shawn David Rogers, Johns Creek, GA (US); James Martin Armfield, Atlanta, GA (US); Craig A. Bunn, Cumming, GA (US); Tobi Stoll, Suwanee, GA (US)

(73) Assignee: Honeywell International Inc., Morris Plains, NJ (US)

( * ) Notice: Subject to any disclaimer, the term of this patent is extended or adjusted under 35 U.S.C. 154(b) by 208 days.

(21) Appl. No.: 13/975,683

(22) Filed: Aug. 26, 2013

(65) Prior Publication Data

US 2015/0054596 A1 Feb. 26, 2015

(51) Int. Cl.

| | |
|---|---|
| ***H01P 5/12*** | (2006.01) |
| ***H01Q 5/47*** | (2015.01) |
| ***H01P 1/16*** | (2006.01) |
| ***H01Q 25/00*** | (2006.01) |

(52) U.S. Cl.

CPC .. *H01Q 5/47* (2015.01); *H01P 1/16* (2013.01); *H01P 5/12* (2013.01); *H01Q 25/00* (2013.01); *Y10T 29/49016* (2015.01)

(58) Field of Classification Search

CPC ..... H01P 1/16; H01P 5/12; H01P 3/20; H01Q 25/00; H01Q 5/47

USPC ..... 333/125, 251

See application file for complete search history.

(56) References Cited

U.S. PATENT DOCUMENTS

| | | | | |
|---|---|---|---|---|
| 4,558,290 | A * | 12/1985 | Lee | 333/126 |
| 7,053,851 | B1 | 5/2006 | Bogdans et al. | |
| 7,821,356 | B2 * | 10/2010 | Espino et al. | 333/125 |
| 8,230,581 | B1 | 7/2012 | Wilcoxon et al. | |

(Continued)

FOREIGN PATENT DOCUMENTS

| | | |
|---|---|---|
| EP | 0778474 | 6/1997 |
| WO | 0041266 | 7/2000 |

OTHER PUBLICATIONS

European Patent Office, "Extended European Search Report from EP Application No. 14172239.7 mailed Jan. 28, 2015", "from Foreign Counterpart of U.S. Appl. No. 13/975,683", Jan. 28, 2015, pp. 1-6, Published in: EP.

*Primary Examiner* — Robert Pascal
*Assistant Examiner* — Kimberly Glenn
(74) *Attorney, Agent, or Firm* — Fogg & Powers LLC

(57) ABSTRACT

A concentric feed is provided. The concentric feed includes an outer-conductive tube electrically connected at a base of an inner-conductive tube to an outer-conductive tube by a process comprising the steps of: configuring the outer-conductive tube; configuring the inner-conductive tube; and positioning the outer-conductive tube to contact the inner-conductive tube at the base. The outer-conductive tube is configured to include: a side-port; a first-edge surface; a first-interior surface sharing an edge with and perpendicular to the first-edge surface; a second-edge surface; and a second-interior surface sharing an edge with and perpendicular to the second-edge surface. The inner-conductive tube is configured to include: the base at a base-end of the inner-conductive tube, the base including a first lip and a second lip protruding orthogonal to a first surface and a second surface, respectively, and a central-port centered on the central axis and parallel to the central axis; and a main-body.

17 Claims, 17 Drawing Sheets

(56) References Cited

U.S. PATENT DOCUMENTS

2002/0163401 A1 11/2002 Zhang
2009/0251233 A1 10/2009 Mahon et al.
2009/0284327 A1 11/2009 Mahon et al.
2011/0037534 A1 2/2011 Espino et al.
2013/0008603 A1 1/2013 Eto et al.
2015/0214616 A1 7/2015 Rogers et al.

* cited by examiner

METHODS FOR RF CONNECTIONS IN CONCENTRIC FEEDS

GOVERNMENT LICENSE RIGHTS

The U.S. Government may have rights in the invention under Government Contract No. H94003-04-D-0005 awarded by the U.S. Government to Northrop Grumman.

BACKGROUND

Depending upon the application, dual band or dual polarization concentric feeds are advantageous in illuminating lens or reflector antennas. For these types of antennas, concentric feeds are used so the system focal point is shared by both of the frequency bands or both of the polarizations. For high performance, the inner-conductive tube and the outer-conductive tube that make up the concentric feed require good electrical connection (electrical short) to each other in the region near the base of the feed. At high frequencies, where the feed parts are small, this important electrical connection is difficult to achieve in a consistent manner. If the electrical connection is not robust and repeatable, from a manufacturing standpoint, then the feed will have poor return loss resulting in increased mismatch loss and reduced antenna gain.

SUMMARY

The present application relates to a concentric feed. The concentric feed includes an outer-conductive tube electrically connected at a base of an inner-conductive tube to an outer-conductive tube by a process comprising the steps of: configuring the outer-conductive tube; configuring the inner-conductive tube; and positioning the outer-conductive tube to contact the inner-conductive tube at the base wherein the outer-conductive tube and the inner-conductive tube are co-aligned to the central axis. The outer-conductive tube is configured to include: a side-port; a first-edge surface; a first-interior surface sharing an edge with and perpendicular to the first-edge surface; a second-edge surface; and a second-interior surface sharing an edge with and perpendicular to the second-edge surface. The inner-conductive tube is configured to include: the base at a base-end of the inner-conductive tube, the base including a first lip and a second lip protruding orthogonal to a first surface and a second surface, respectively, and a central-port centered on the central axis and parallel to the central axis; and a main-body extending in the axial direction from the base.

DRAWINGS

In accordance with common practice, the various described features are not drawn to scale but are drawn to emphasize features relevant to the present invention. Like reference characters denote like elements throughout figures and text.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

This application describes various geometries and connection methods required to achieve consistently high performance in dual band and/or dual polarization concentric feeds. The concentric feeds are made up of inner and outer-conductive tubes that are axially aligned and are thus also referred to in the art as "coaxial feeds". Often dual band and/or dual polarization concentric feeds are designed for the radio frequency (RF) spectral range. In that case, the concentric feeds are referred to as concentric RF feeds.

A concentric feed includes two conductors: an inner-conductive tube and outer-conductive tube, which are formed from metal or metal alloys. One electromagnetic wave propagates within the circular waveguide inside the inner tube. A second electromagnetic wave propagates within the coaxial waveguide formed and bounded by the outer surface of the inner conductor and the inner surface of the outer conductor. The coaxial waveguide requires an electrically-conductive connection between the inner-conductive tube and outer-conductive tube at the base of the concentric feed that is consistently the same. If the manufacturing process to conductively attach the inner-conductive tube to the outer-conductive tube is not repeatable, the impedance matching of the coaxial portion of the concentric feed is not consistently the same. For example, air gaps at the connection point between the inner and outer-conductive tubes change the impedance and the concentric feed has a poor return loss. If the manufacturing of the connection of the concentric feeds is not robust or repeatable, the resultant antenna gains are not optimum. The embodiments of concentric RF feeds described herein reduce or eliminate the variations between multiple concentric feeds used to create a multi-beam antenna. It is understood that the area of concern for the electrical connection in this application is the coaxial region of the concentric feed. In that case, concentric feeds are coaxial regions of the concentric feeds.

Figure 1B:
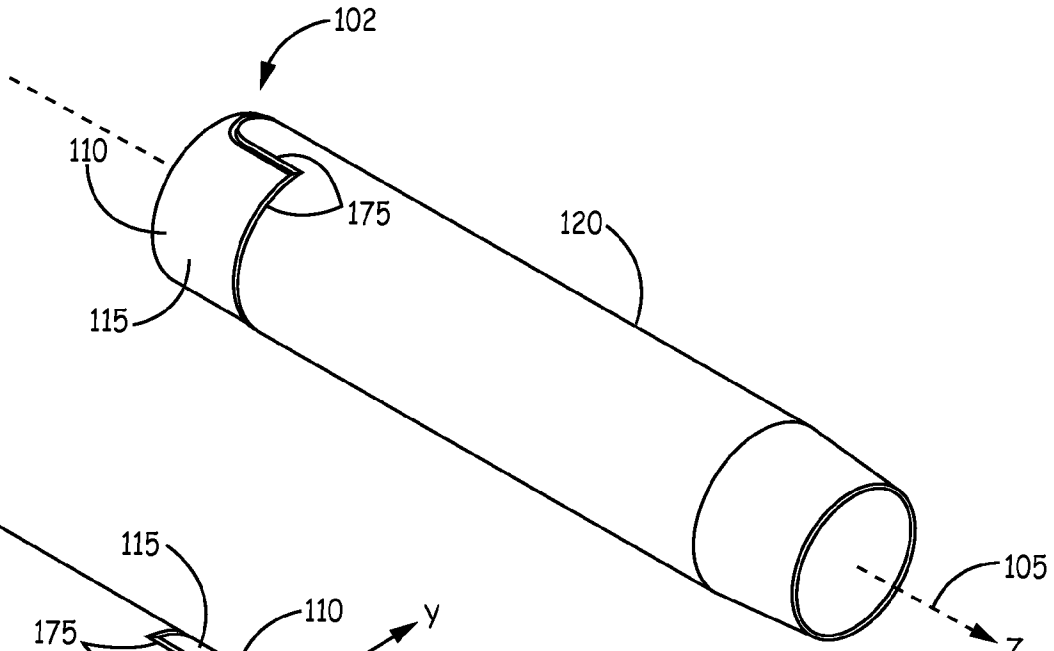
FIGS. 1A and 1B are opposing oblique views of a concentric feed in accordance with an embodiment of the present application.
Figure 1A:
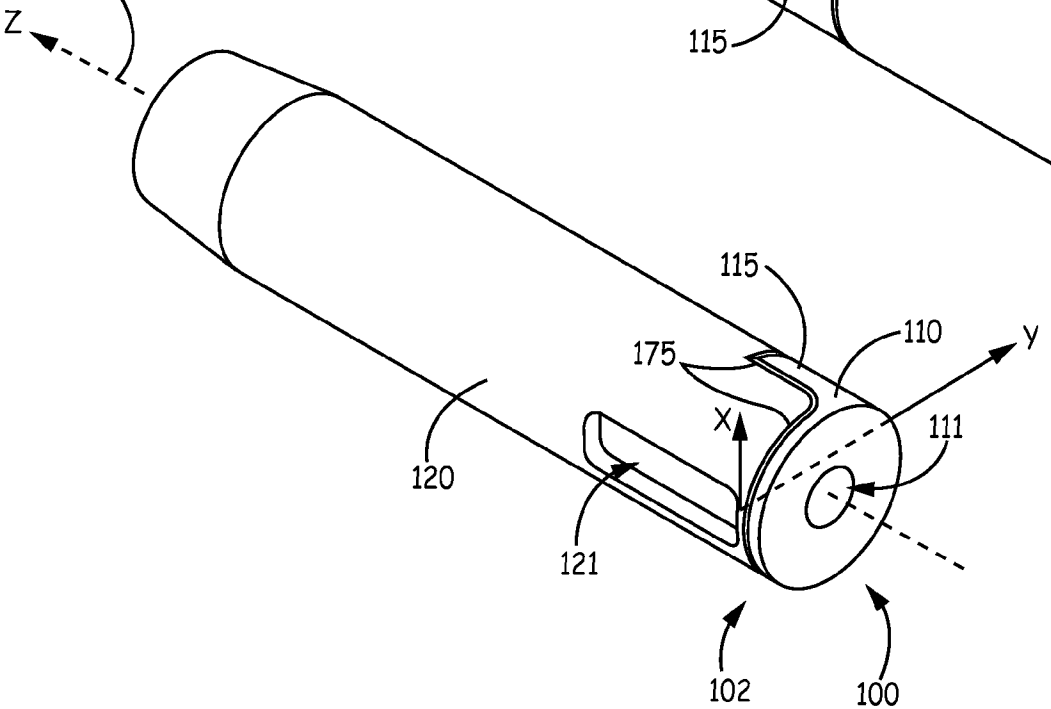
Figure 2:
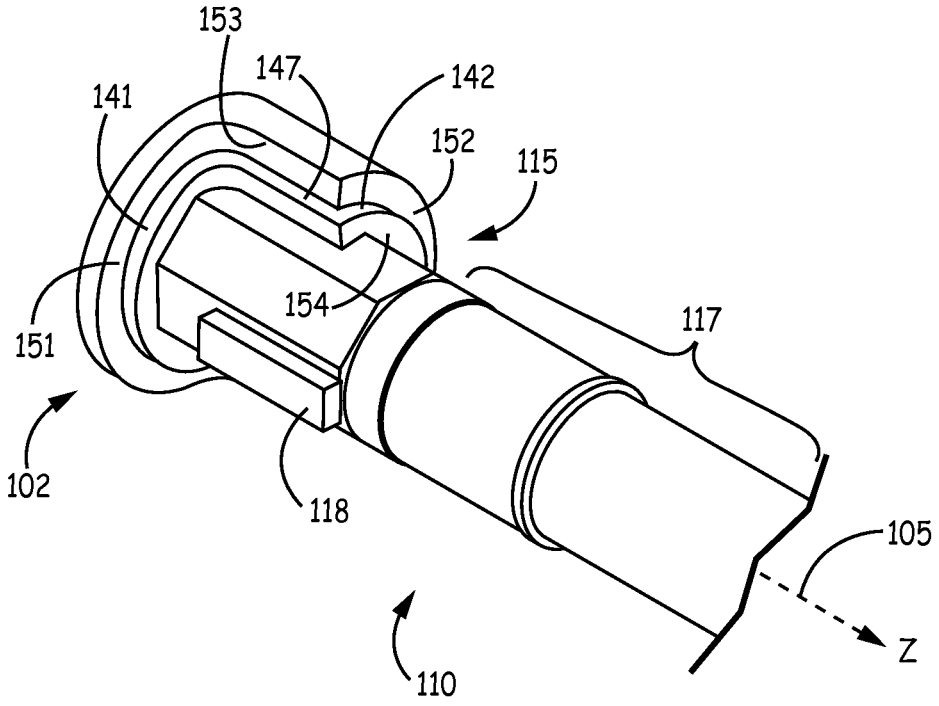
FIG. 2 is a view of an inner-conductive tube of the concentric feed of FIGS. 1A and 1B.
Figure 3A:
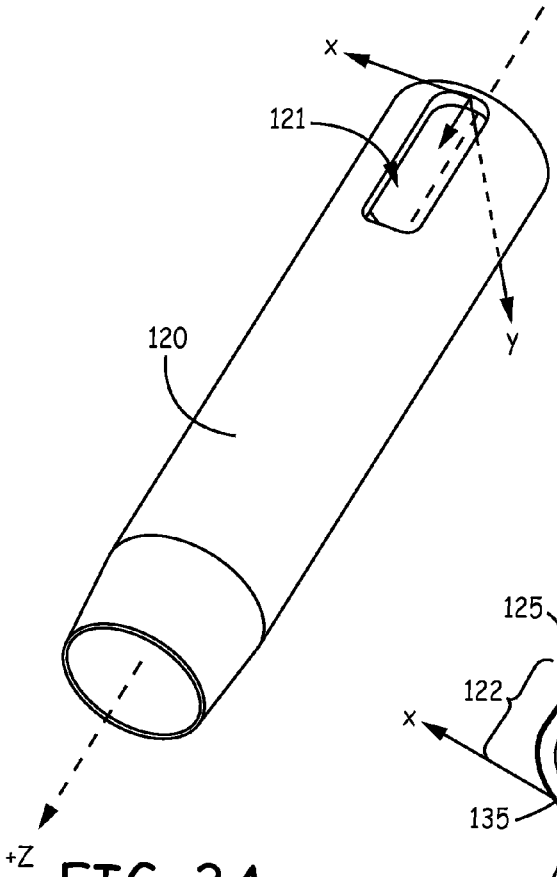
FIGS. 3A and 3B are views of an outer-conductive tube of the concentric feed of FIGS. 1A and 1B.
Figure 3B:
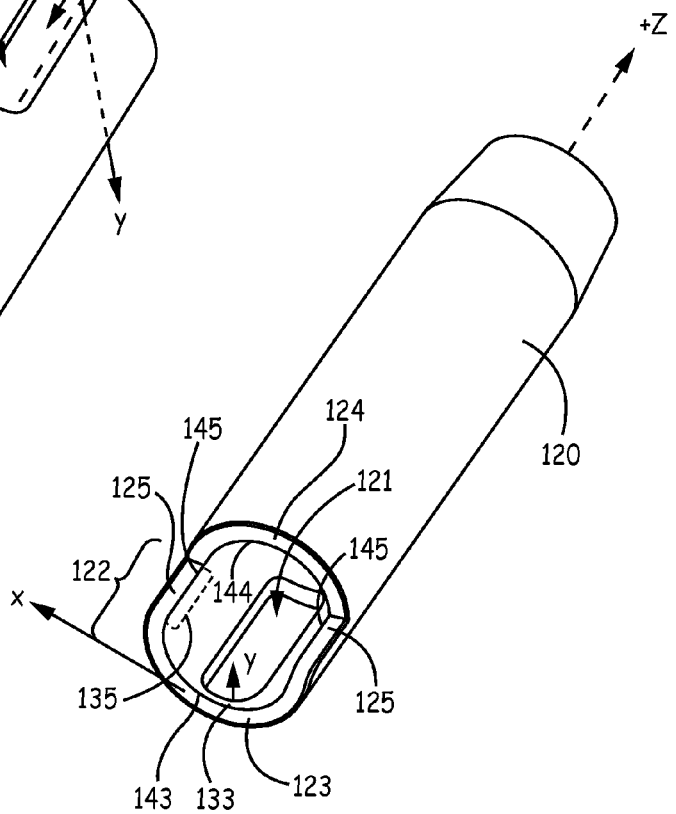
Figure 4:
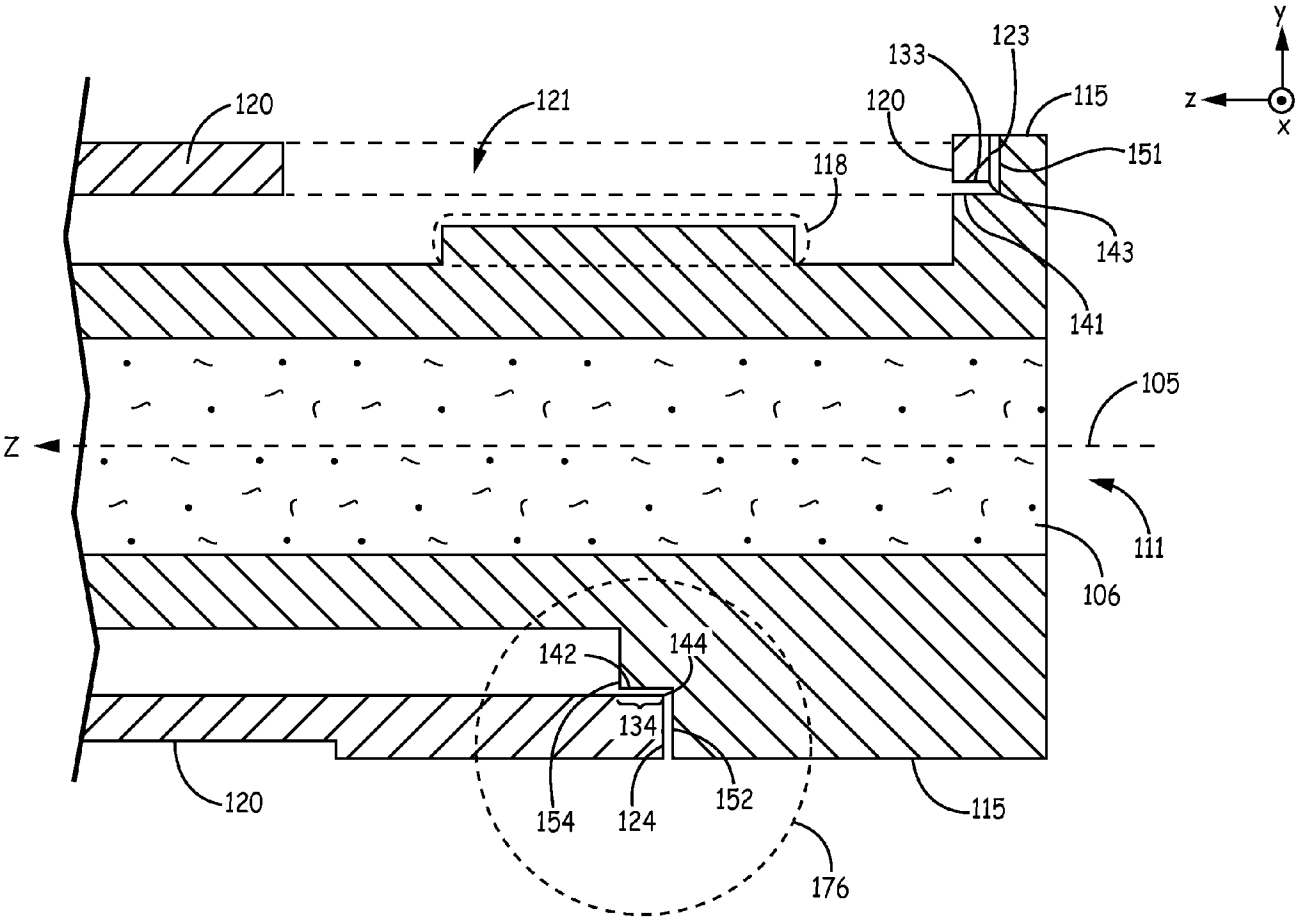
FIG. 4 is an exploded view of the interface between the inner-conductive tube and the outer-conductive tube of the concentric feed of FIGS. 1A and 1B.
Figure 5:
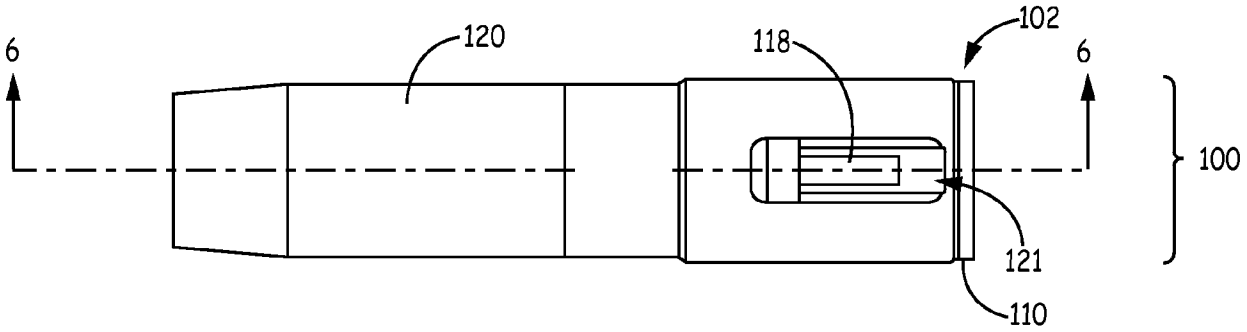
FIG. 5 is a top view of the concentric feed of FIGS. 1A and 1B.
Figure 6:
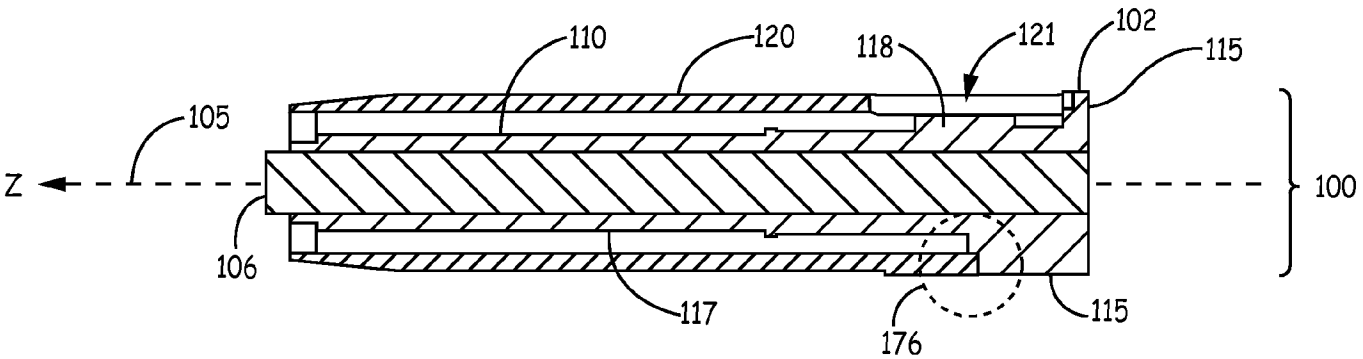
FIG. 6 is a cross-sectional view of the concentric feed of FIG. 5.
Figure 7:
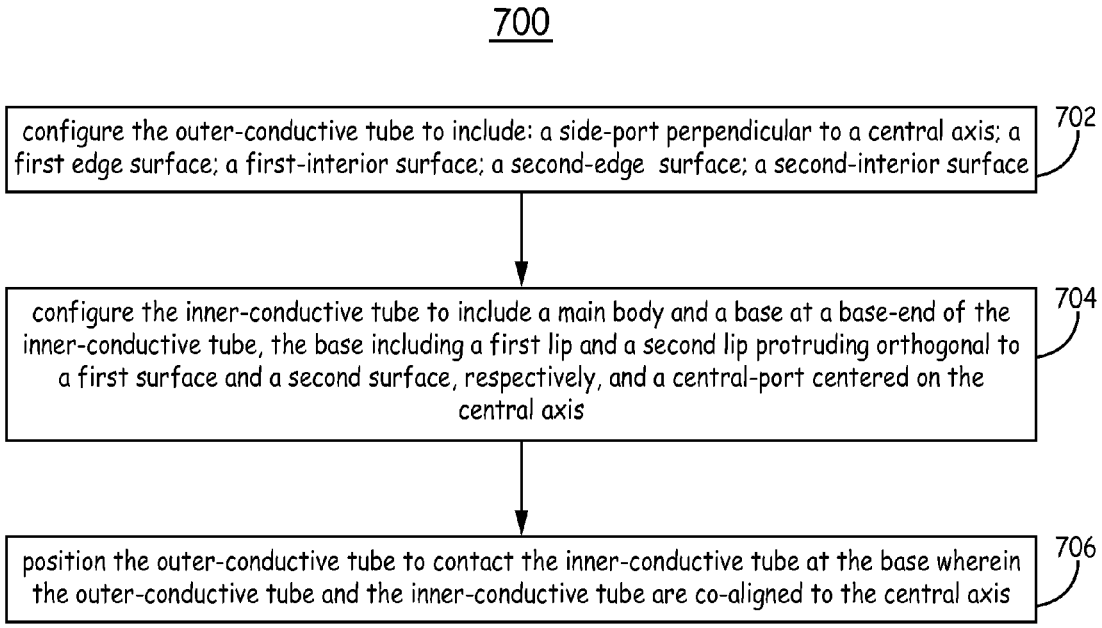
FIG. 7 is a flow diagram of a method to form a concentric feed in accordance with the present application.

A first embodiment is shown in FIGS. 1A-6. FIGS. 1A and 1B are opposing oblique views of a concentric feed 100 in accordance with an embodiment of the present application. FIG. 2 is a view of an inner-conductive tube 110 of the concentric feed 100 of FIGS. 1A and 1B. FIGS. 3A and 3B are views of an outer-conductive tube 120 of the concentric feed of FIGS. 1A and 1B. FIG. 4 is an exploded view of the interface between the inner-conductive tube 110 and the outer-conductive tube 120 of the concentric feed 100 of FIGS. 1A and 1B. FIG. 5 is a top view of the concentric feed 100 of FIGS. 1A and 1B. FIG. 6 is a cross-sectional view of the concentric feed of FIG. 5. The plane upon which the cross-section view of FIG. 6 is taken is indicated by section line 6-6 in FIG. 5. FIG. 7 is a flow diagram of a method 700 to form a concentric feed 100 in accordance with the present application. The "outer-conductive tube" is also referred to herein as "outer tube". The "inner-conductive tube" is also referred to herein as "inner tube".

The concentric feed 100 includes an outer-conductive tube 120 (FIGS. 3A and 3B) and an inner-conductive tube 110 (FIG. 2). As shown in FIGS. 3B and 4, the outer-conductive tube 120 includes a side-port 121, a first-edge surface 123, a first-interior surface 133, a second-edge surface 124, a second-interior surface 134, a third-edge surface 125, and a third-interior surface 135. The first-interior surface 133 shares an edge 143 with the first-edge surface 123 and is perpendicular to the first-edge surface 123. The second-interior surface 134 shares an edge 144 with the second-edge surface 124 and is perpendicular to the second-edge surface 124. The third-interior surface 135 shares an edge 145 (FIG. 3B) with the third-edge surface 125 and is perpendicular to the third-edge surface 125.

The inner-conductive tube 110 includes a base 115 at a base-end 102 (FIGS. 1A, 1B, and 2) of the inner-conductive tube 110 and a main-body 117 extending in the axial direction from the base 115. The base 115 includes a first lip 141 that protrudes orthogonal to a first surface 151 (FIGS. 2 and 4). The base 115 includes a second lip 142 that protrudes orthogonal to a second surface 152 (FIGS. 2 and 4). The base 115 also include a third lip 147 that protrudes orthogonal to a third surface 153 (FIG. 2). As defined herein, a lip is a projecting edge or rim protruding from a surface. The base 115 also includes a central-port 111 (FIGS. 1A and 4) centered on a central axis 105 that is aligned in the +Z direction. The axial direction is aligned to the central axis 105. The base 115 and the main-body 117 are formed from metal or metal alloys. As shown in FIGS. 4, 5, and 6, the protuberance 118 is positioned adjacent to the side-port 121 and does not protrude into side-port 121. The shape of the protuberance 118 is designed to improve the impedance matching of port 121.

The outer-conductive tube 120 is electrically connected to the base 115 of the inner-conductive tube 110 at all the points of contact between them as shown in the cross-sectional view of the concentric feed 100 of FIG. 6. The most critical area for the two tubes to be joined is indicated by dashed circle 176 (FIGS. 4 and 6). This area 176 of the concentric feed 100, which is only shown in cross-section in FIGS. 4 and 6, is opposite the side-port 121. It is to be noted that the critical area 176 extends along the half diameter of the cylinders outer-conductive tube 120 and the inner-conductive tube 110. FIG. 4 shows an enlarged, exploded cross section view of the area 176 of the concentric feed 100 and the side-port 121. FIG. 4 is an exploded view in order to clearly show the various surfaces of the outer-conductive tube 120 and the inner-conductive tube 110.

The surface 154 shown in FIG. 4 is often called the "short" since, in the absence of gaps in the critical region 176, it presents a short circuit between the inner conductor main body 117 and the outer conductor 120. This surface 154 being a good conductor causes the electric field on its surface and tangential to it to be zero (or nearly zero). Thus, the x and y components of electric field on the surface 154 (FIGS. 2 and 4) are zero. Note that the shorting surface 154 covers a bottom half of the base region 115 of the inner tube 110 and is opposite the protuberance 118 as shown in FIG. 2. The location of the short 154 in the z direction and the dimensions of the protuberance 118 are optimized to provide the best impedance match looking into port 121. This is typically done using commercial full-wave electromagnetic computer simulation software such as Ansys HFSS™ (High Frequency Structure Simulator) or CST (Computer Simulation Technology) Microwave Studio®.

As shown in FIGS. 4 and 6, dielectric material 106 is (optionally) positioned within the inner-conductive tube 110.

The side-port 121 spans a surface in an X-Z plane (FIGS. 1A, 5, and 6). The central-port 111 spans an X-Y plane orthogonal to the central axis 105 (FIGS. 1A, 5, and 6). Electro-magnetic waves that propagate into the concentric feed 100 via the central-port 111 propagate generally in the Z direction parallel to the central axis 105 within inner-conductive tube 110. Electro-magnetic waves that propagate into the concentric feed 100 via the side-port 121 first propagate generally in the Y direction to couple into the outer-conductive tube 120 for propagation in the Z direction within the space between the inner-conductive tube 110 and the outer-conductive tube 120. In one implementation of this embodiment, energy in a first frequency range (or at a first polarization) is coupled to the side-port 121 of the concentric feed 100 to propagate through the coaxial region of the concentric feed 100. In this case, the energy in a second frequency range (or at a second polarization that is orthogonal to the first polarization) is coupled to the central-port 111 to propagate through the center of the concentric feed 100.

The concentric feed 100 is manufactured according to the flow diagram shown in FIG. 7. At block 702, the outer-conductive tube 120 is configured to include the side-port 21, the first-edge surface 123, the first-interior surface 133 that shares an edge 143 with and perpendicular to the first-edge surface 123, the second-edge surface 124, the second-interior surface 134 (FIG. 4) that shares an edge 144 with and is perpendicular to the second-edge surface 124. For the embodiment shown in FIGS. 1A-6, at block 702, the outer-conductive tube 120 is also configured to include a third-edge surface 125, and a third-interior surface 135 that shares an edge 145 (FIG. 3B) with and is perpendicular to the third-edge surface 125. In one implementation of this embodiment, the outer-conductive tube 120 is machined from an aluminum tube or block.

At block 704, the inner-conductive tube 110 is configured to include the base 115 and the main-body 117 extending in the axial direction from the base 115. The base 115 is at a base-end 102 of the inner-conductive tube 110 and is formed to include the central-port 111 centered on the central axis 105 the base 111. Specifically, the base 115 is formed with a first lip 141 and a second lip 142 protruding orthogonal to a first surface 151 and a second surface 152, respectively. For the embodiment shown in FIGS. 1A-6, at block 702, the base 115 of the inner-conductive tube 110 is also configured to include a third lip 147 protruding orthogonal to a third surface 153. A dielectric material 106 is optionally positioned within the inner-conductive tube 110 either after the inner-conductive tube 110 is machined or after the inner-conductive tube 110 is attached to the outer-conductive tube 120.

The base 115 and the main-body 117 are formed from metal. In one implementation of this embodiment, the base 115 and the main-body 117 are machined from a single tube or block of metal. In one implementation of this embodiment, the base 115 and the main-body 117 are machined from two separate tubes or blocks and then the base 115 and the main-body 117 are attached to each other by welding.

At block 706, the outer-conductive tube 120 is positioned to contact the inner-conductive tube 110 at the base 115 so the outer-conductive tube 120 and the inner-conductive tube 110 are co-aligned to the central axis 105. As is shown in FIG. 3B, the second-edge surface 124 and the third-edge surface 125 form a cut-out region represented generally at 122 of a cylinder from which the outer-conductive tube 120 is formed. The seams 175 between outer-conductive tube 120 and the inner-conductive tube 110 (FIGS. 1A and 1B) clearly show that the base 115 of the inner-conductive tube 110 conforms to the cut-out region 122 in the outer-conductive tube 120.

The outer-conductive tube 120 is positioned to interlock with the inner-conductive tube 110, shown in FIGS. 1A, 1B, and 4-6. The first-edge surface 123 of the outer-conductive tube 120 is adjacent to the first surface 151 of the base, the second-edge surface 124 of the outer-conductive tube 120 is adjacent to the second surface 152 of the base, and the third-edge surface 125 of the outer-conductive tube 120 is adjacent to the third surface 153 of the base 115. The first-interior surface 133 is positioned adjacent to the first lip 141, the second-interior surface 134 is positioned adjacent to the second lip 142, and the third-interior surface 135 is positioned adjacent to the third lip 147. As defined herein, two adjacent surfaces are either touching (at least in part) or have a small gap between them.

In one embodiment of the concentric feed 100, the component parts are machined to meet tolerances such that the outer tube 120 will slide over the inner tube 110 into the interlocking positions described above. This situation is known to those skilled in the art of machining as a "slip fit". In this embodiment, in order for the outer-conductive tube 120 to slip fit with the inner-conductive tube 110, the inner tube tolerances and outer tube tolerances are defined such that there is guaranteed physical contact, and hence electrical contact, of the second-edge surface 124 of the outer tube 120 and the second surface 152 of the inner tube 110. Due to tolerances, the remaining outer tube edge surfaces 123 and 125 are in very close proximity to but are not necessarily electrically contacting their respective corresponding inner tube surfaces 151 and 153. The interior surfaces 133, 134, 135 of the outer tube 120 are in very close proximity to the respective inner tube lip surfaces 141, 142, 147 such that there are areas with unpredictable gaps and areas of unpredictable physical contact. However, since these areas and gaps are small compared to the wavelength of the signal of interest, they do not degrade the performance of the concentric feed 100. Additionally, the connection of the second-edge surface 124 of the outer-conductive tube 120 and the second surface 152 of the inner tube 110 appears, from the viewpoint of the electromagnetic fields, as continuous metal. This configuration results in a good impedance match looking into port 121.

In another embodiment of the concentric feed 100, the dimensions of the interior surfaces 133, 134, 135 of the outer tube 120 are slightly oversized relative to those of the respective inner tube lip surfaces 141, 142, 147. In this embodiment, there exists an interference fit, also known as a press fit or friction fit, when the parts are connected since the inner tube 110 slightly interferes with the space occupied by the outer tube 120. A non-trivial force is required to press the outer tube 120 over the inner tube 110. In this case, the outer-conductive tube 120 is fixedly attached to the inner-conductive tube 110 when the outer-conductive tube 120 contacts the inner-conductive tube 110. The interior surfaces 133, 134, 135 of the outer tube 120 and the respective inner tube lip surfaces 141, 142, 147 are effectively merged and these areas appear from the viewpoint of the electromagnetic fields as continuous metal.

In another implementation of this embodiment, after slip fitting as described above, the outer-conductive tube 120 is laser welded to the inner-conductive tube 110 in order to fixedly attach the outer-conductive tube 120 to the inner-conductive tube 110. In such an embodiment, the laser welding is done at the seams 175 shown in FIGS. 1A and 1B to fuse the metals together so there are no gaps along the outside surfaces of the concentric feed 100. Laser welding works very well as a technique for connecting the inner-conductive tube 110 to the outer-conductive tube 120. The resulting bond is excellent from an RF standpoint and also creates a solid mechanical connection. However, laser welding can potentially create large gaps and holes (also referred to as "blow outs") in the areas desired to be joined if there is no metal below the seam. The configuration of the concentric feed 100 is advantageous for laser welding since the first, second, and third lips 141, 142, and 143 provide a ledge that acts as a backing for the laser weld seam 175 and eliminate the possibility for blow-outs.

Since the laser welding process is very precise and is mechanically repeatable, the concentric feed 100 can be manufactured for good, repeatable RF performance. As is known to one skilled in the art of laser welding, dissimilar metal alloys are desired for good laser welds. The inner-conductive tube 110 and the outer-conductive tube 120 are formed from different metal alloys when laser welding is used to fixedly attach the inner-conductive tube 110 to the outer-conductive tube 120. In one implementation of this embodiment, the inner-conductive tube 110 is formed from aluminum alloy 6061 and the outer-conductive tube 120 is formed from aluminum alloy 4047.

Figure 8:
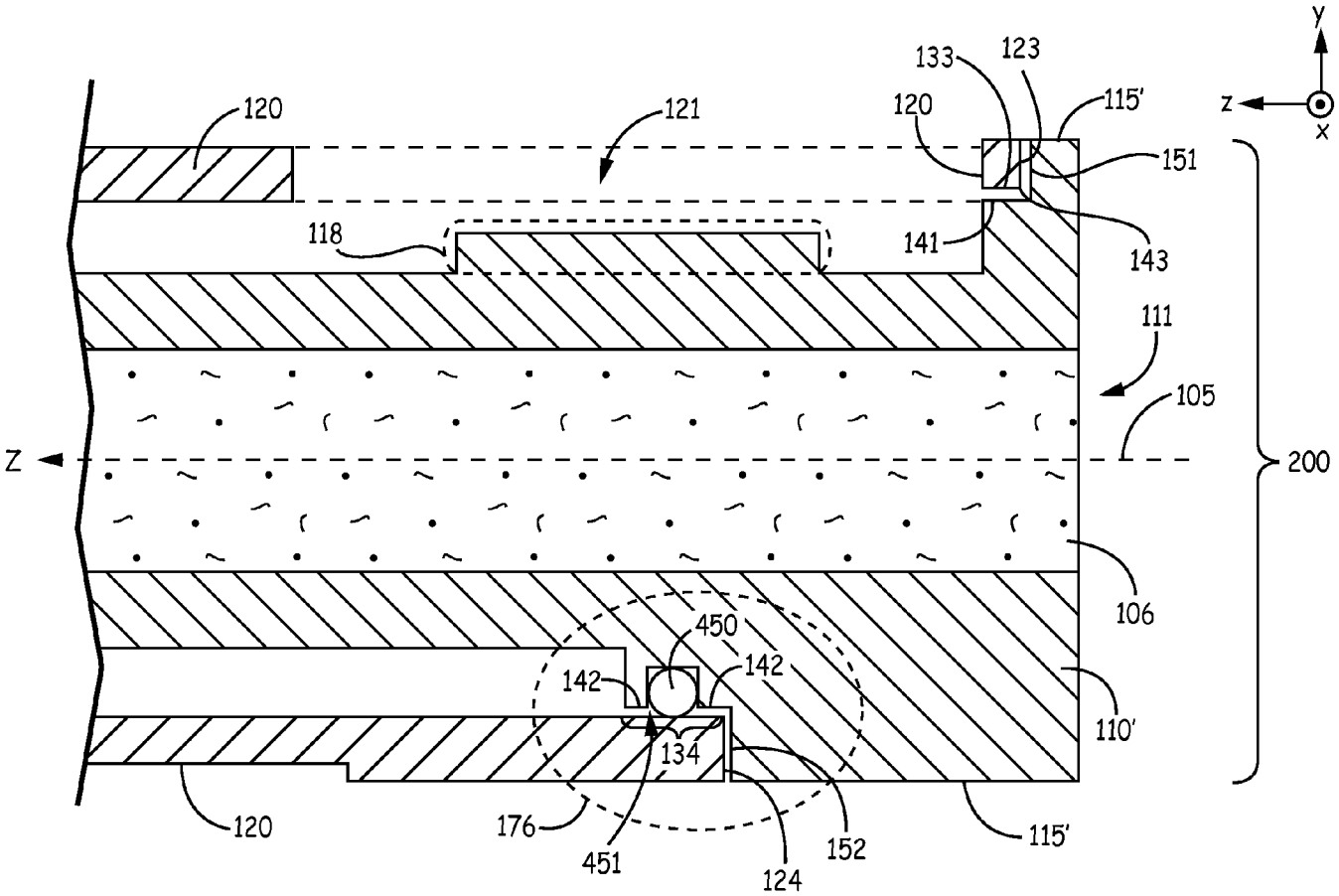
FIG. 8 is an exploded view of the interface between the inner-conductive tube and the outer-conductive tube of an embodiment of a concentric feed in accordance with an embodiment of the present application.

FIG. 8 is an exploded view of the interface between the inner-conductive tube 110' and the outer-conductive tube 120 of an embodiment of a concentric feed 200 in accordance with an embodiment of the present application. The concentric feed 200 differs from the concentric feed 100 in that a groove 451 is formed in the second lip 142 of the inner-conductive tube 110' and an electrically conductive gasket 450 is inserted in the groove 451. The inner-conductive tube 220 is the same in structure and function as the inner-conductive tube 120 in the concentric feed 100. In this embodiment shown in FIG. 8, when the outer-conductive tube 120 is positioned to contact the inner-conductive tube 110', the second-interior surface 134 is positioned adjacent to the second lip 142 to contact the electrically conductive gasket 450 in the groove 451 to the second-interior surface 134. Thus, even if there is a gap between the second-interior surface 134 and the second lip 142, the electrically conductive gasket 450 provides the electrical contact (electrical short) between the second-interior surface 134 and the second lip 142 at the critical area 176 (FIGS. 4 and 6) of the concentric feed 200 opposite the side-port 121.

The electrically conductive gasket 450 is formed from an elastomer or other polymers infused with microscopic silver particles (or other metal particles) to make the elastomer or other polymer material electrically conductive. The electrically conductive gasket 450 is also referred to herein as an elastomeric gasket 450", an "RF gasket 450", and a "gasket 450". The conductive elastomeric gasket 450 is not visible from the outside of the concentric feed 200 when the concentric feed 200 is assembled. A conductive elastomeric gasket is commercially available from Parker Hannifin Corporation's Chomerics Division or Laird Technologies, Inc. The conductive elastomeric gaskets described in this patent application are used in a different function from prior art applications, which use these gaskets to reduce EMI (electromagnetic interference) in metal enclosures of electronic parts.

The concentric feed 200 requires a few additional steps in manufacturing in addition to the steps shown in method 700 of FIG. 7. A trough or groove 451, as shown in FIG. 8, is cut into at least a portion of the second lip 142 of the base 115' of the inner-conductive tube 110'. Then the electrically conductive gasket 450 is inserted into the groove 451. The outer-conductive tube 120 slides over the inner-conductive tube 110' with the gasket 450 in place.

Figure 9:
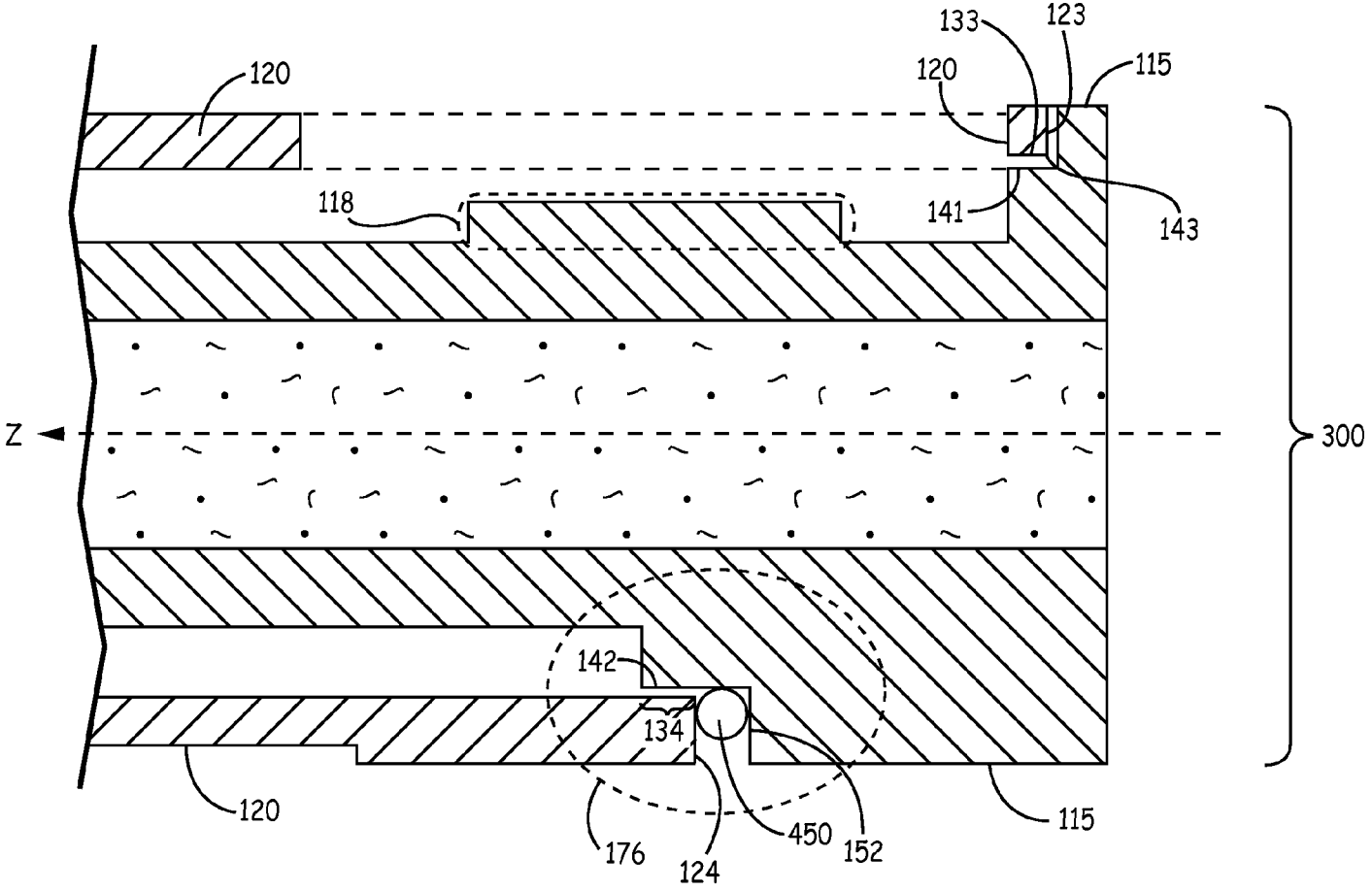
FIG. 9 is an exploded view of the interface between the inner-conductive tube and the outer-conductive tube of an embodiment of a concentric feed in accordance with an embodiment of the present application.

FIG. 9 is an exploded view of the interface between the inner-conductive tube 110 and the outer-conductive tube 120 of an embodiment of a concentric feed 300 in accordance with an embodiment of the present application. The concentric feed 300 differs from the concentric feed 100 in that an electrically conductive gasket 450 is inserted between the second surface 152 of the inner-conductive tube 110 and the second-edge surface 124 of the outer-conductive tube 120. The second-edge surface 124 of the outer-conductive tube 120 electrically contacts the second surface 152 of the base 115 via the electrically conductive gasket 450.

In one implementation of this embodiment, the inner-conductive tube 110 and the outer-conductive tube 120 are the same as in the concentric feed 100. In another implementation of this embodiment, the length of the cut-out region 122 in the outer-conductive tube 120 (shown in FIG. 3B) is slightly longer to offset for the additional thickness of the electrically conductive gasket 450 that is inserted between the second surface 152 of the inner-conductive tube 110 and the second-edge surface 124 of the outer-conductive tube 120. In this embodiment, the conductive elastomeric gasket 450 is visible from the outside of the concentric feed 300 when the concentric feed 300 is assembled.

The concentric feed 300 requires an additional step in manufacturing in addition to the steps shown in FIG. 7. Prior to completing the contact between the outer-conductive tube 120 and the inner-conductive tube 110 (at block 706), as the outer-conductive tube 120 slides over the inner-conductive tube 110, the electrically conductive gasket 450 is positioned in the corner formed by the second lip 142 and the second surface 152 of the inner-conductive tube 110.

In other embodiments of concentric feeds, the cut-out region 122 in the outer-conductive tube 120 (shown in FIG. 3B) is reduced to a relatively small tab and the base of the inner-conductive tube is shaped with a mating indent to accept the tab. The tab and indent are for the purpose of aligning the inner-conductive tube and outer-conductive tube. An example of this embodiment is shown in FIGS. 10A-19.

Figures 10A, 10B:
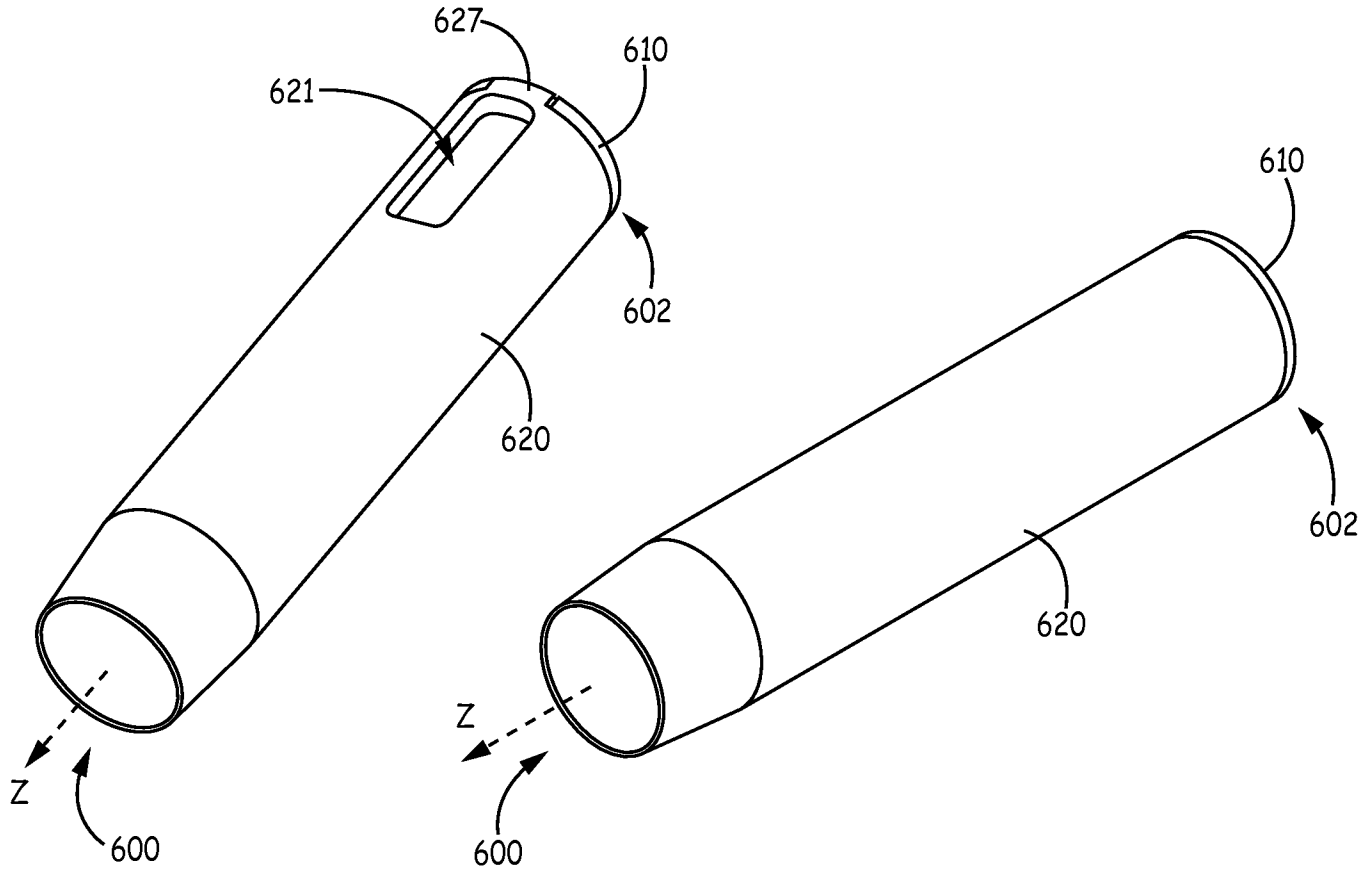
FIGS. 10A and 10B are opposing oblique views of a concentric feed in accordance with an embodiment of the present application.
Figure 11:
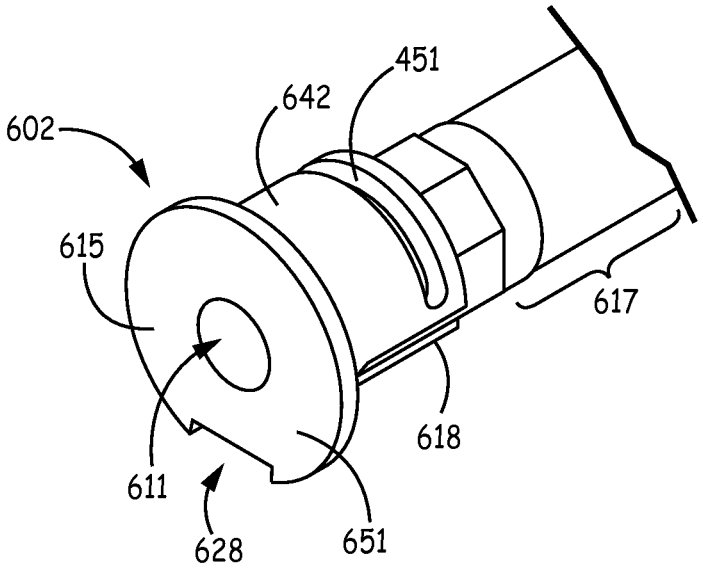
FIGS. 11 and 12 are views of an inner-conductive tube of the concentric feed of FIGS. 10A and 10B.
Figure 12:
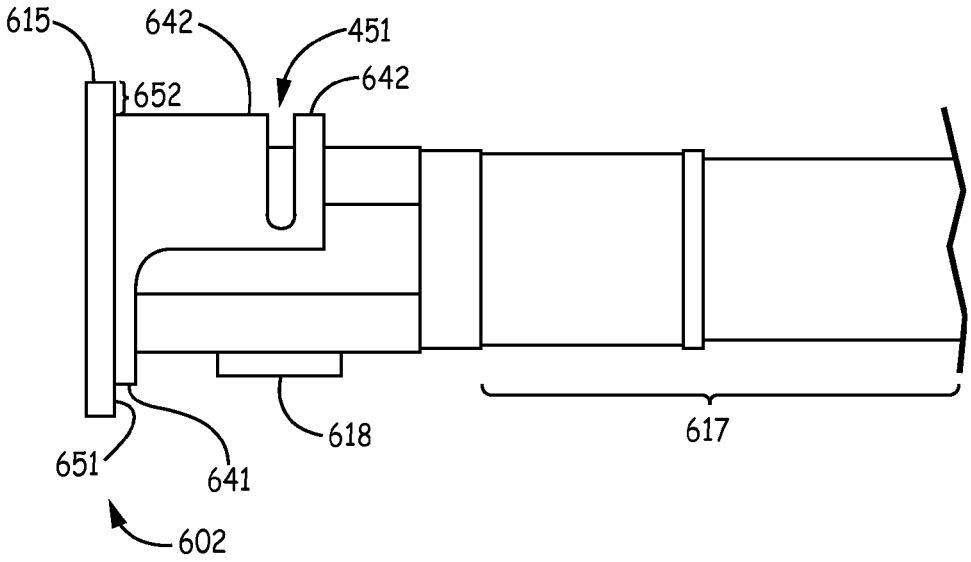
Figure 14:
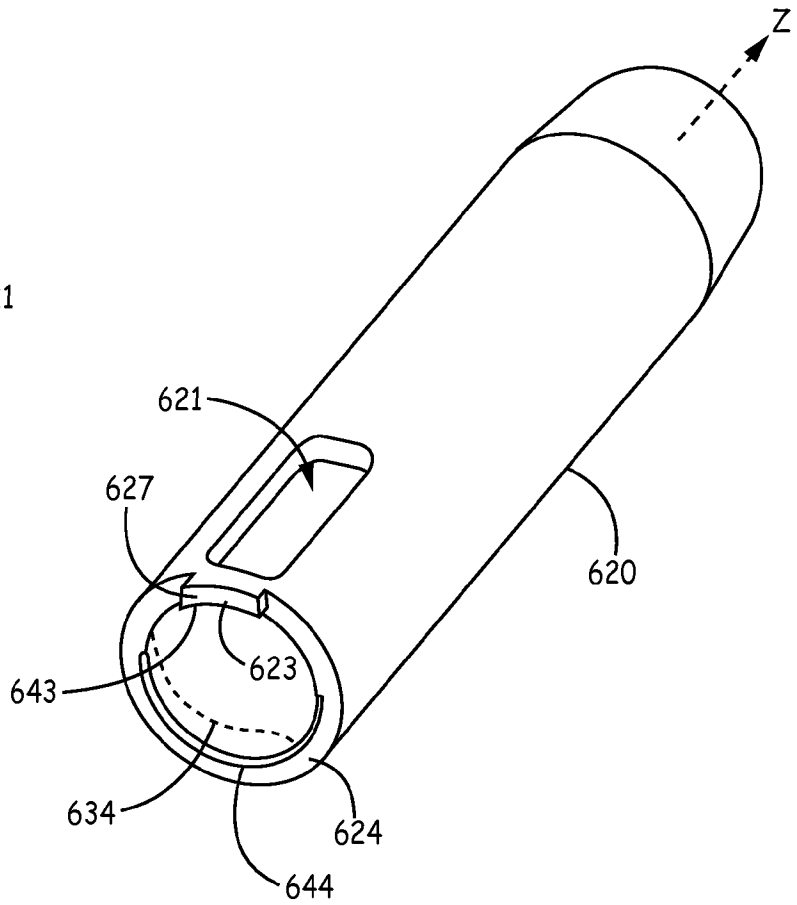
FIGS. 13 and 14 are views of an outer-conductive tube of the concentric feed of FIGS. 10A and 10B.
Figure 13:
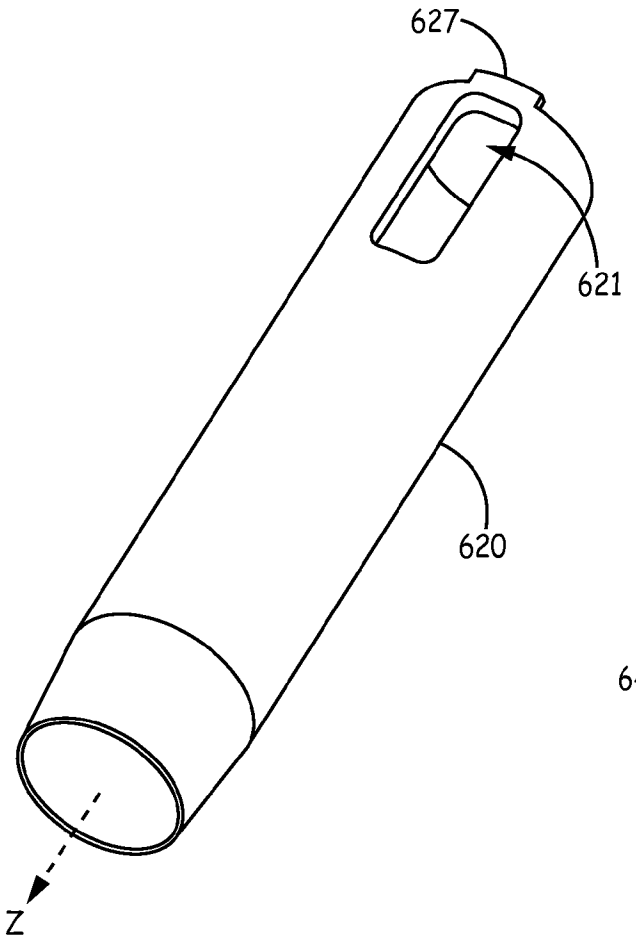
Figure 15:
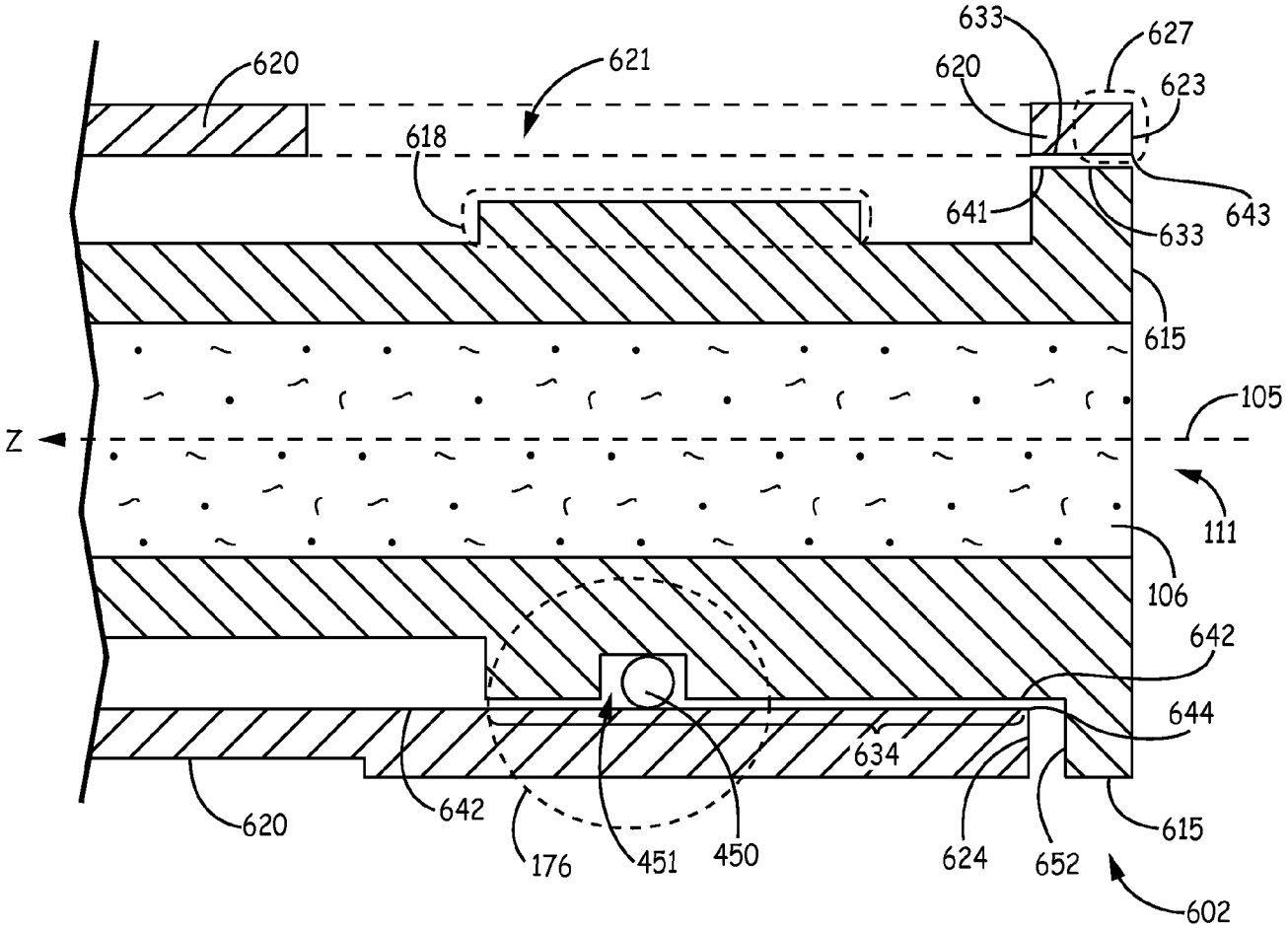
FIG. 15 is an exploded view of the interface between the inner-conductive tube and the outer-conductive tube of the concentric feed of FIGS. 10A and 10B.
Figure 16:
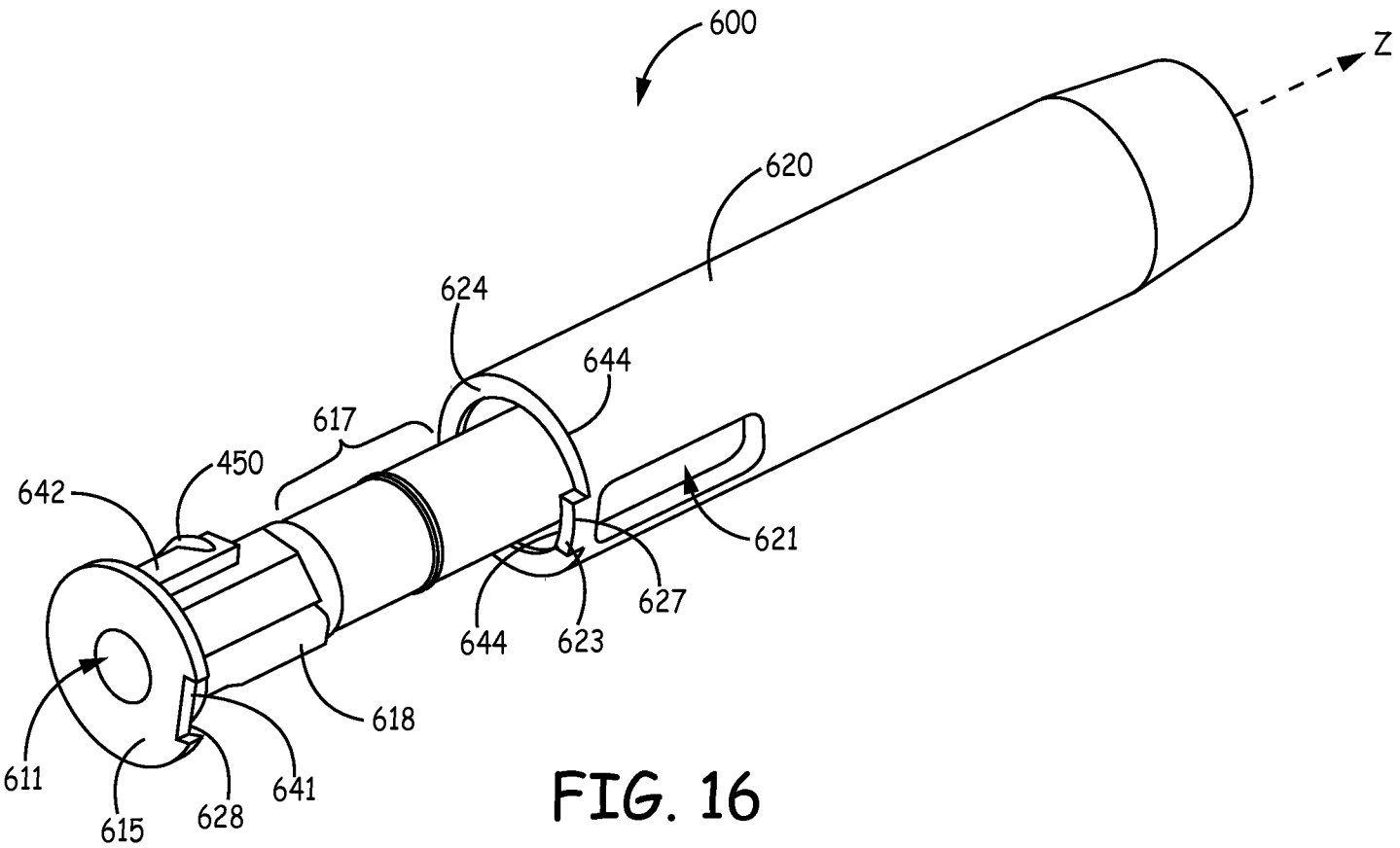
FIG. 16 is a view of the outer-conductive tube being mated with the inner-conductive tube to form the concentric feed of FIGS. 10A and 10B.
Figure 17:
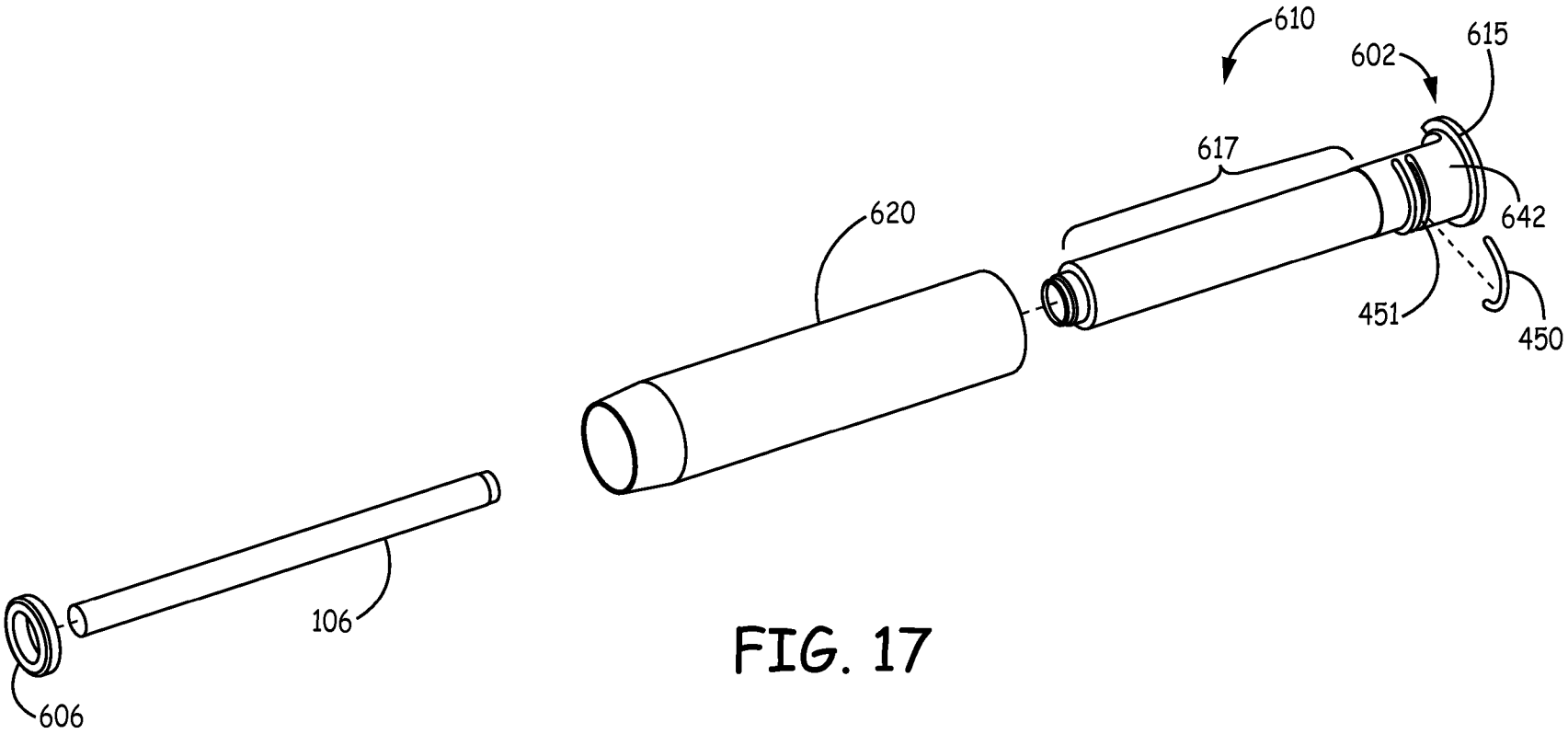
FIG. 17 is an exploded view of the components of the concentric feed of FIGS. 10A and 10B.
Figure 18:
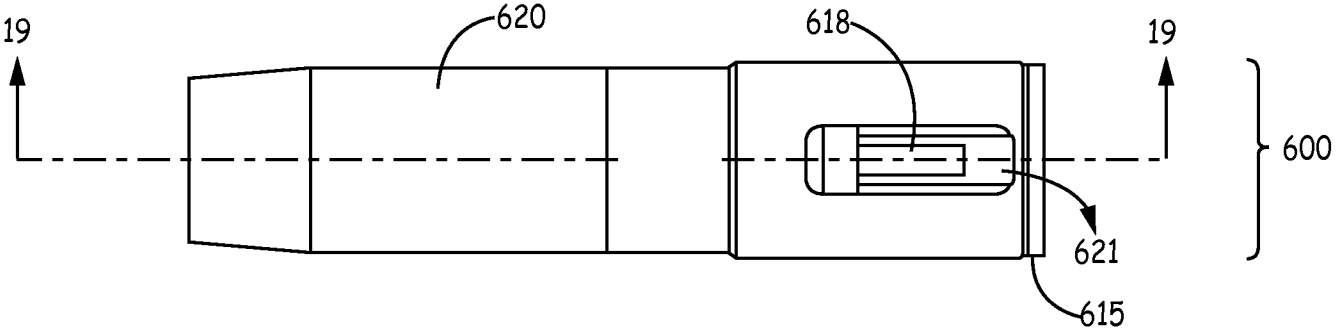
FIG. 18 is a top view of the concentric feed of FIGS. 10A and 10B.
Figure 19:
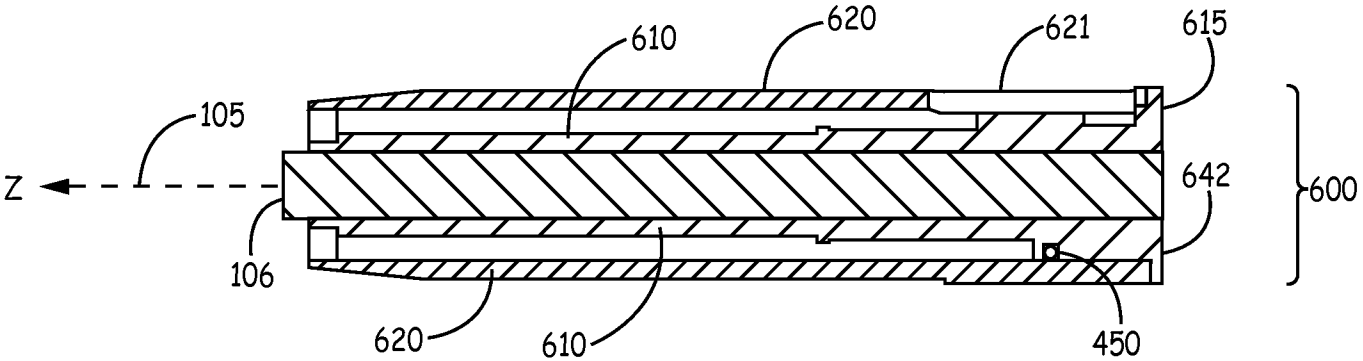
FIG. 19 is a cross-sectional view of the concentric feed of FIG. 18.

FIGS. 10A and 10B are opposing oblique views of a concentric feed 600 in accordance with an embodiment of the present application. FIGS. 11 and 12 are views of an inner-conductive tube 610 of the concentric feed 600 of FIGS. 10A and 10B. FIGS. 13 and 14 are views of an outer-conductive tube 620 of the concentric feed 600 of FIGS. 10A and 10B. FIG. 15 is an exploded view of the interface between the inner-conductive tube 610 and the outer-conductive tube 620 of the concentric feed 600 of FIGS. 10A and 10B. FIG. 16 is a view of the outer-conductive tube 620 being mated with the inner-conductive tube 610 to form the concentric feed 600 of FIGS. 10A and 10B. FIG. 17 is an exploded view of the components 610, 620, 106, and 606 of the concentric feed 600 of FIGS. 10A and 10B. FIG. 18 is a top view of the concentric feed 600 of FIGS. 10A and 10B. FIG. 19 is a cross-sectional view of the concentric feed 600 of FIG. 18. The concentric feed 600 has the same function as the concentric feeds 100, 200, and 300 described above.

The concentric feed 600 includes an inner-conductive tube 610 that is electrically shorted to an outer-conductive tube 620. As shown in FIG. 11, the inner-conductive tube 610 includes a central-port 611 that is similar in structure and function to the central port 111 of the concentric feed 100. As shown in FIGS. 13 and 14, the outer-conductive tube 620 includes a side-port 621 that is similar in structure and function to the side-port 621 of the concentric feed 100.

An indent 628 is formed in the base 615 (FIG. 11) of the inner-conductive tube 610. In this embodiment, the first lip 641 is an interior surface 641 (FIG. 15) of the indent 628 and the first surface 651 is a flat-external-base surface 651 (FIGS. 11 and 15) in which the central-port 611 is formed. A groove 451 (FIGS. 11, 12, and 15) is formed in the base 615. The base 615 includes a protuberance 618 and is designed to improve the impedance matching between the outer-conductive tube 620 and the inner-conductive tube 610. Aside from the indent 628 and the groove 451, the base 615 is similar in structure to the base 115 of the above referenced embodiments of the concentric feeds 100 and 300. Aside from the indent 628, the base 615 is similar in structure to the base 115' of the embodiment of the concentric feed 200 shown in FIG. 8.

The outer-conductive tube 620 includes a tab 627 as shown in FIGS. 13, 14, and 16, which is relatively small in dimension along the Z direction. Thus, the cut-out 122 of the outer-conductive tube 120 is reduced in size to the length of the tab 627 along the axial direction.

In this embodiment, an electrically conductive gasket 450 is inserted in the groove 451 of the base 615. When the outer-conductive tube 620 is positioned to contact the inner-conductive tube 610, the tab 627 fits into the indent 628. The first-interior surface 633 (FIG. 15) of the outer-conductive tube 620 is positioned adjacent to the interior surface 641 (FIG. 15) of the indent 628 in the base 615. The second-edge surface 624 of the outer-conductive tube 620 contacts the second surface 652 of the base 615. The second-interior surface 634 is positioned adjacent to the second lip 642 to contact the electrically conductive gasket 450 in the groove 451. The second lip 642 is an extended version of the lip 142 shown in FIG. 4.

The component 606 (FIG. 17) is a dielectric plug 606 positioned at the radiating end of the concentric feed 600. The radiating end opposes the base end 602 (FIGS. 10A, 10B, 11, 12, 15, and 17) of the concentric feed 600. The dielectric plug 606 positioned at the radiating end of the concentric feed 600 functions to maintain the concentricity of the concentric feed 600 and to provide a seal from the external environment, if necessary. Without the dielectric plug 606, the inner-conductive tube 610 and outer-conductive tube 620 would almost touch at the radiating end, since the RF gasket 450 exerts a force that tips the inner-conductive tube 110 off center. Thus, the dielectric plug 606 would be useful in the embodiment of the concentric feed 200 shown in FIG. 8. In some antenna feed designs, it is preferable to delete the dielectric plug 606. In those antenna feeds, laser welding a slip-fit assembly or applying an interference fit is necessary to maintain concentricity of the tubes.

The concentric feed 600 requires a few additional steps in manufacturing in addition to the steps shown in method 700 of FIG. 7. An indent 628 is formed in the base 615 and a groove 451 is formed in the base 615 as part of configuring the inner-conductive tube 610. In this case, the first lip 641 is an interior surface 641 of the indent 628 and the first surface 651 is a flat-external-base 615 surface 651 in which the central-port 611 is formed.

Before the outer-conductive tube 620 is positioned to contact the inner-conductive tube 610, the electrically conductive gasket 450 is inserted in the groove 451. When the outer-conductive tube 620 is positioned to contact the inner-conductive tube 610 (as in block 706 of FIG. 7), the second-interior surface 634 is positioned adjacent to the second lip 642 to contact the electrically conductive gasket 450 in the groove 451 to the second-interior surface 634. This connection ensures the connected region, from the viewpoint of the electromagnetic fields, is a continuous metal piece so there is no impedance mismatch of port 621 caused by the critical area 176 shown in FIG. 15 of the concentric feed 600 opposite the side-port 621.

The embodiments of concentric feeds described herein are used to guide electromagnetic fields coupled to the outer-conductive tube 120 (620) and the inner-conductive tube 110 (610). The electromagnetic fields in a first frequency band are coupled via a central-port 111 (611), in the base 115 (615), to propagate through the circular waveguide within the inner-conductive tube 110 (610) along the central axis 105. The electromagnetic fields in a second frequency band are coupled via a side-port 121 (621) perpendicular to the central axis 105 to propagate in the +Z direction through the coaxial waveguide formed by the interior of the outer-conductive tube 120 (620) and exterior of the inner-conductive tube 110 (610).

Alternatively, both the circular waveguide and coaxial waveguide could be used for signals within the same frequency band, but having orthogonal polarizations. For example, the circular waveguide could be used to propagate a vertical polarization, while the coaxial waveguide could be used for a horizontal polarization. Although their description is beyond the scope of this patent application, polarizers could be included within the concentric feed. In that case, one polarization could be right hand circular polarization (RHCP) and the other could be left hand circular polarization (LHCP).

Figure 20:
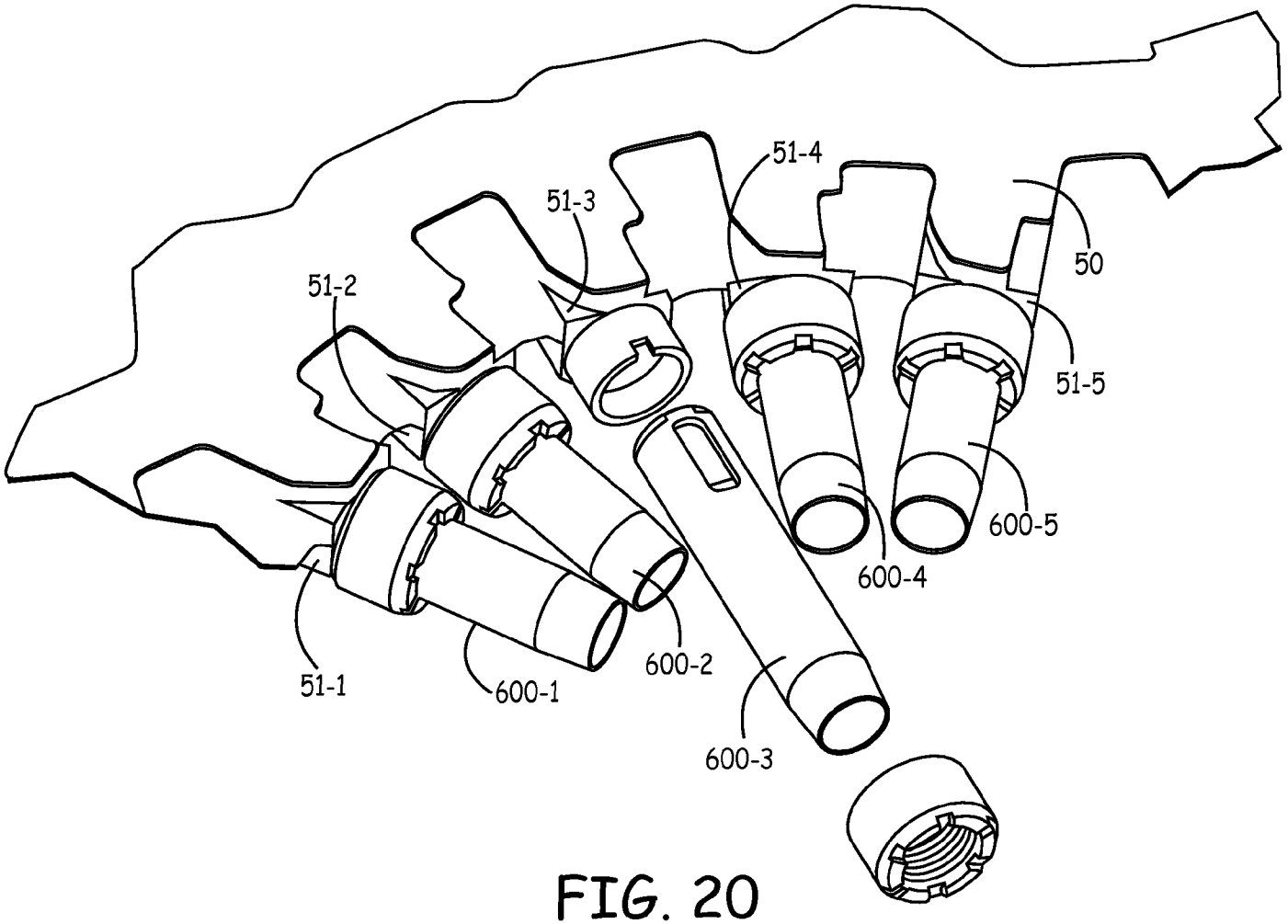
FIG. 20 is a view of a dual-band switch tree with a plurality of the concentric feed of FIGS. 10A and 10B.

A dual-band concentric antenna feed 100, 200, 300, or 600 is configured to interface with the dual-band switch tree 50 as shown in FIG. 20. FIG. 20 is a view of a dual-band switch tree 50 with a plurality of the concentric feed 600(1-5) of FIGS. 10A and 10B. As shown in FIG. 20, the concentric feed 600-3 is positioned to be inserted into port 51-3 of the dual-band switch tree 50 and the concentric feeds 600-1, 600-2, 600-4, and 600-5 are operationally positioned in the ports 50-1, 50-2, 50-4, and 50-5, respectively, of the dual-band switch tree 50. In other embodiments, the multiple switch trees 50 are loaded with multiple concentric feeds 100, 200 or 300 to create a multi-beam antenna as known in the art. The plurality of concentric feeds 100, 200, 300, or 600 in the multiple switch tree 50 operate to feed a lens, which in turn radiates power in desired directions for communications.

EXAMPLE EMBODIMENTS

Example 1 includes a concentric feed including an outer-conductive tube electrically connected at a base of an inner-conductive tube to an outer-conductive tube by a process comprising the steps of: configuring the outer-conductive tube to include: a side-port; a first-edge surface; a first-interior surface sharing an edge with and perpendicular to the first-edge surface; a second-edge surface; and a second-interior surface sharing an edge with and perpendicular to the second-edge surface; configuring the inner-conductive tube to include: the base at a base-end of the inner-conductive tube, the base including a first lip and a second lip protruding orthogonal to a first surface and a second surface, respectively, and a central-port centered on the central axis and parallel to the central axis; and a main-body extending in the axial direction from the base; and positioning the outer-conductive tube to contact the inner-conductive tube at the base wherein the outer-conductive tube and the inner-conductive tube are co-aligned to the central axis.

Example 2 includes the concentric feed of Example 1, the process further comprising the steps of: configuring the outer-conductive tube to further include: a third-edge surface; and a third-interior surface sharing an edge with and perpendicular to the third-edge surface; configuring the inner-conductive tube to further include a third lip on the base protruding orthogonal to a third surface.

Example 3 includes the concentric feed of Example 2, the process further comprising the steps of: forming a groove in the second lip; and inserting an electrically conductive gasket in the groove, wherein the process of positioning the outer-conductive tube to contact the inner-conductive tube comprises: contacting the first-edge surface of the outer-conductive tube to the first surface of the base; positioning the first-interior surface adjacent to the first lip; contacting the second-edge surface of the outer-conductive tube to the second surface of the base; positioning the second-interior surface adjacent to the second lip to contact the electrically conductive gasket in the groove to the second-interior surface; contacting the third-edge surface of the outer-conductive tube to the third surface of the base; and positioning the third-interior surface adjacent to the third lip.

Example 4 includes the concentric feed of any of Examples 2-3, wherein the process of positioning the outer-conductive tube to contact the inner-conductive tube comprises: contacting the first-edge surface of the outer-conductive tube to the first surface of the base; positioning the first-interior surface adjacent to the first lip; contacting the second-edge surface of the outer-conductive tube to the second surface of the base; positioning the second-interior surface adjacent to the second lip; contacting the third-edge surface of the outer-conductive tube to the third surface of the base; and positioning the third-interior surface adjacent to the third lip.

Example 5 includes the concentric feed of any of Examples 2-4, the process further comprising the steps of: inserting an electrically conductive gasket between the second surface of the inner-conductive tube and the second-edge surface of the outer-conductive tube, wherein the process of positioning the outer-conductive tube to contact the inner-conductive tube further comprises: contacting the first-edge surface of the outer-conductive tube to the first surface of the base; positioning the first-interior surface adjacent to the first lip; contacting the second-edge surface of the outer-conductive tube to the second surface of the base via the electrically conductive gasket; positioning the second-interior surface adjacent to the second lip; contacting the third-edge surface of the outer-conductive tube to the third surface of the base; and positioning the third-interior surface adjacent to the third lip.

Example 6 includes the concentric feed of any of Examples 1-5, wherein configuring the inner-conductive tube further comprises the steps of: forming an indent in the base, wherein the first lip is an interior surface of the indent and wherein the first surface is a flat-external-base surface in which the central-port is formed; and forming a groove in the base, and wherein positioning the outer-conductive tube to contact the inner-conductive tube further comprises the steps of: inserting an electrically conductive gasket in the groove of the base; positioning the first-interior surface of the outer-conductive tube adjacent to the interior surface of the indent in the base; contacting the second-edge surface of the outer-conductive tube to the second surface of the base; and positioning the second-interior surface adjacent to the second lip to contact the electrically conductive gasket in the groove to the second-interior surface.

Example 7 includes the concentric feed of any of Examples 1-6, further comprising the step of positioning dielectric material within the inner-conductive tube.

Example 8 includes the concentric feed of any of Examples 1-7, the process further comprising the step of slip fitting the outer-conductive tube to the inner-conductive tube.

Example 9 includes the concentric feed of any of Examples 1-8, the process further comprising the step of laser welding the outer-conductive tube to the inner-conductive tube.

Example 10 includes a concentric feed comprising: a outer-conductive tube including: a side-port; a first-edge surface; a first-interior surface sharing an edge with and perpendicular to the first-edge surface; a second-edge surface; a second-interior surface sharing an edge with and perpendicular to the second-edge surface; an inner-conductive tube including: a base at a base-end of the inner-conductive tube, the base including a first lip and a second lip protruding orthogonal to a first surface and a second surface, respectively, and a central-port centered on a central axis; a main-body extending in an axial direction from the base, wherein the outer-conductive tube contacts the inner-conductive tube at the base, and wherein the outer-conductive tube and the inner-conductive tube are co-aligned to the central axis.

Example 11 includes the concentric feed of Example 10, wherein the outer-conductive tube further comprises: a third-edge surface; and a third-interior surface sharing an edge with and perpendicular to the third-edge surface, and wherein the inner-conductive tube further comprises: a third lip on the base protruding orthogonal to a third surface.

Example 12 includes the concentric feed of Example 11, wherein the inner-conductive tube further comprises: a groove formed in the second lip; and an electrically conductive gasket inserted in the groove, wherein the first-edge surface of the outer-conductive tube contacts the first surface of the base, the first-interior surface is positioned adjacent to the first lip, the second-edge surface of the outer-conductive tube contacts the second surface of the base, the second-interior surface is positioned adjacent to the second lip to contact the electrically conductive gasket in the groove to the second-interior surface, the third-edge surface of the outer-conductive tube contacts the third surface of the base, and the third-interior surface is positioned adjacent to the third lip.

Example 13 includes the concentric feed of any of Examples 11-12, wherein the first-edge surface of the outer-conductive tube contacts the first surface of the base, the first-interior surface is positioned adjacent to the first lip, the second-edge surface of the outer-conductive tube contacts the second surface of the base, the second-interior surface is positioned adjacent to the second lip, the third-edge surface of the outer-conductive tube contacts the third surface of the base, and the third-interior surface is positioned adjacent to the third lip.

Example 14 includes the concentric feed of any of Examples 11-13, further comprising: an electrically conductive gasket inserted between the second surface of the inner-conductive tube and the second-edge surface of the outer-conductive tube, wherein the first-edge surface of the outer-conductive tube contacts the first surface of the base, the first-interior surface is positioned adjacent to the first lip, the second-edge surface of the outer-conductive tube contacts the second surface of the base via the electrically conductive gasket, the second-interior surface is positioned adjacent to the second lip; the third-edge surface of the outer-conductive tube contacts the third surface of the base, and the third-interior surface is positioned adjacent to the third lip.

Example 15 includes the concentric feed of any of Examples 10-14, wherein the inner-conductive tube further comprises: an indent formed in the base, wherein the first lip is an interior surface of the indent and wherein the first surface is a flat-external-base surface; a groove formed in the base; and an electrically conductive gasket inserted in the groove of the base, wherein the first-interior surface of the outer-conductive tube is positioned adjacent to the interior surface of the indent in the base; the second-edge surface of the outer-conductive tube contacts the second surface of the base; and the second-interior surface is positioned adjacent to the second lip to contact the electrically conductive gasket in the groove to the second-interior surface.

Example 16 includes a process of forming a concentric feed including an outer-conductive tube electrically connected to a base of an inner-conductive tube, the process comprising: configuring the outer-conductive tube to include: a side-port; a first-edge surface; a first-interior surface sharing an edge with and perpendicular to the first-edge surface; a second-edge surface; a second-interior surface sharing an edge with and perpendicular to the second-edge surface; configuring the inner-conductive tube to include: a base at a base-end of the inner-conductive tube, the base including a first lip and a second lip protruding orthogonal to a first surface and a second surface, respectively, and a central-port centered on a central axis; and a main-body extending in an axial direction from the base; and positioning the outer-conductive tube to contact the inner-conductive tube at the base wherein the outer-conductive tube and the inner-conductive tube are co-aligned to the central axis.

Example 17 includes the process of Example 16, further comprising: configuring the outer-conductive tube to further include: a third-edge surface; and a third-interior surface sharing an edge with and perpendicular to the third-edge surface; configuring the inner-conductive tube to further include a third lip on the base protruding orthogonal to a third surface.

Example 18 includes the process of any of Examples 16-17, further comprising: forming a groove in the second lip; and inserting an electrically conductive gasket in the groove, wherein the process of positioning the outer-conductive tube to contact the inner-conductive tube comprises: contacting the first-edge surface of the outer-conductive tube to the first surface of the base; positioning the first-interior surface adjacent to the first lip; contacting the second-edge surface of the outer-conductive tube to the second surface of the base; positioning the second-interior surface adjacent to the second lip to contact the electrically conductive gasket in the groove to the second-interior surface; contacting the third-edge surface of the outer-conductive tube to the third surface of the base; and positioning the third-interior surface adjacent to the third lip.

Example 19 includes the concentric feed of any of Examples 16-18, wherein configuring the inner-conductive tube further comprises the steps of: forming an indent in the base, wherein the first lip is an interior surface of the indent and wherein the first surface is a flat-external-base surface in which the central-port is formed; and forming a groove in the base, and wherein positioning the outer-conductive tube to contact the inner-conductive tube further comprises the steps of: inserting an electrically conductive gasket in the groove of the base; positioning the first-interior surface of the outer-conductive tube adjacent to the interior surface of the indent in the base; contacting the second-edge surface of the outer-conductive tube to the second surface of the base; and positioning the second-interior surface adjacent to the second lip to contact the electrically conductive gasket in the groove to the second-interior surface.

Example 20 includes the concentric feed of any of Examples 16-19, the process further comprising the step of laser welding the outer-conductive tube to the inner-conductive tube.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof

What is claimed is:

1. A concentric feed including an outer-conductive tube electrically connected at a base of an inner-conductive tube to an outer-conductive tube by a process comprising the steps of:

configuring the outer-conductive tube to include:

a side-port;

a first-edge surface;

a first-interior surface sharing an edge with and perpendicular to the first-edge surface;

a second-edge surface; and a second-interior surface sharing an edge with and perpendicular to the second-edge surface;

a third-edge surface; and a third-interior surface sharing an edge with and perpendicular to the third-edge surface, an inner-conductive tube including:

a base at a base-end of the inner-conductive tube, the base including a first lip protruding orthogonal to a first surface of the base, a second lip protruding orthogonal to a second surface of the base, and a third lip protruding orthogonal to a third surface of the base and a central-port centered on a central axis; and configuring the inner-conductive tube to include:

the base at a base-end of the inner-conductive tube, the base including a first lip and a second lip protruding orthogonal to a first surface and a second surface, respectively, and a central-port centered on the central axis and parallel to the central axis; and a main-body extending in the axial direction from the base; and positioning the outer-conductive tube to contact the inner-conductive tube at the base wherein the outer-conductive tube and the inner-conductive tube are co-aligned to the central axis.

2. The concentric feed of claim 1, the process further comprising the steps of:

forming a groove in the second lip; and inserting an electrically conductive gasket in the groove, wherein the process of positioning the outer-conductive tube to contact the inner-conductive tube comprises:

contacting the first-edge surface of the outer-conductive tube to the first surface of the base;

positioning the first-interior surface adjacent to the first lip;

contacting the second-edge surface of the outer-conductive tube to the second surface of the base;

positioning the second-interior surface adjacent to the second lip to contact the electrically conductive gasket in the groove to the second-interior surface;

contacting the third-edge surface of the outer-conductive tube to the third surface of the base; and positioning the third-interior surface adjacent to the third lip.

3. The concentric feed of claim 1, wherein the process of positioning the outer-conductive tube to contact the inner-conductive tube comprises:

contacting the first-edge surface of the outer-conductive tube to the first surface of the base;

positioning the first-interior surface adjacent to the first lip;

contacting the second-edge surface of the outer-conductive tube to the second surface of the base;

positioning the second-interior surface adjacent to the second lip;

contacting the third-edge surface of the outer-conductive tube to the third surface of the base; and positioning the third-interior surface adjacent to the third lip.

4. The concentric feed of claim 1, the process further comprising the steps of:

inserting an electrically conductive gasket between the second surface of the inner-conductive tube and the second-edge surface of the outer-conductive tube, wherein the process of positioning the outer-conductive tube to contact the inner-conductive tube further comprises:

contacting the first-edge surface of the outer-conductive tube to the first surface of the base;

positioning the first-interior surface adjacent to the first lip;

contacting the second-edge surface of the outer-conductive tube to the second surface of the base via the electrically conductive gasket;

positioning the second-interior surface adjacent to the second lip;

contacting the third-edge surface of the outer-conductive tube to the third surface of the base; and positioning the third-interior surface adjacent to the third lip.

5. The concentric feed of claim 1, wherein configuring the inner-conductive tube further comprises the steps of:

forming an indent in the base, wherein the first lip is an interior surface of the indent and wherein the first surface is a flat-external-base surface in which the central-port is formed; and forming a groove in the base, and wherein positioning the outer-conductive tube to contact the inner-conductive tube further comprises the steps of:

inserting an electrically conductive gasket in the groove of the base;

positioning the first-interior surface of the outer-conductive tube adjacent to the interior surface of the indent in the base;

contacting the second-edge surface of the outer-conductive tube to the second surface of the base; and positioning the second-interior surface adjacent to the second lip to contact the electrically conductive gasket in the groove to the second-interior surface.

6. The concentric feed of claim 1, further comprising the step of positioning dielectric material within the inner-conductive tube.

7. The concentric feed of claim 1, the process further comprising the step of slip fitting the outer-conductive tube to the inner-conductive tube.

8. The concentric feed of claim 1, the process further comprising the step of laser welding the outer-conductive tube to the inner-conductive tube.

9. A concentric feed comprising:

a outer-conductive tube including:

a side-port;

a first-edge surface;

a first-interior surface sharing an edge with and perpendicular to the first-edge surface;

a second-edge surface;

a second-interior surface sharing an edge with and perpendicular to the second-edge surface;

a third-edge surface; and a third-interior surface sharing an edge with and perpendicular to the third-edge surface; and an inner-conductive tube including:

a base at a base-end of the inner-conductive tube, the base including a first lip protruding orthogonal to a first surface of the base, a second lip protruding orthogonal to a second surface of the base, and a third lip protruding orthogonal to a third surface of the base and a central-port centered on a central axis;

a main-body extending in an axial direction from the base, wherein the outer-conductive tube contacts the inner-conductive tube at the base, and wherein the outer-conductive tube and the inner-conductive tube are co-aligned to the central axis.

10. The concentric feed of claim 9, wherein the inner-conductive tube further comprises:

a groove formed in the second lip; and an electrically conductive gasket inserted in the groove, wherein the first-edge surface of the outer-conductive tube contacts the first surface of the base, the first-interior surface is positioned adjacent to the first lip, the second-edge surface of the outer-conductive tube contacts the second surface of the base, the second-interior surface is positioned adjacent to the second lip to contact the electrically conductive gasket in the groove to the second-interior surface, the third-edge surface of the outer-conductive tube contacts the third surface of the base, and the third-interior surface is positioned adjacent to the third lip.

11. The concentric feed of claim 9, wherein the first-edge surface of the outer-conductive tube contacts the first surface of the base, the first-interior surface is positioned adjacent to the first lip, the second-edge surface of the outer-conductive tube contacts the second surface of the base, the second-interior surface is positioned adjacent to the second lip, the third-edge surface of the outer-conductive tube contacts the third surface of the base, and the third-interior surface is positioned adjacent to the third lip.

12. The concentric feed of claim 9, further comprising:

an electrically conductive gasket inserted between the second surface of the inner-conductive tube and the second-edge surface of the outer-conductive tube, wherein the first-edge surface of the outer-conductive tube contacts the first surface of the base, the first-interior surface is positioned adjacent to the first lip, the second-edge surface of the outer-conductive tube contacts the second surface of the base via the electrically conductive gasket, the second-interior surface is positioned adjacent to the second lip;

the third-edge surface of the outer-conductive tube contacts the third surface of the base, and the third-interior surface is positioned adjacent to the third lip.

13. The concentric feed of claim 9, wherein the inner-conductive tube further comprises:

an indent formed in the base, wherein the first lip is an interior surface of the indent and wherein the first surface is a flat-external-base surface;

a groove formed in the base; and an electrically conductive gasket inserted in the groove of the base, wherein the first-interior surface of the outer-conductive tube is positioned adjacent to the interior surface of the indent in the base;

the second-edge surface of the outer-conductive tube contacts the second surface of the base; and the second-interior surface is positioned adjacent to the second lip to contact the electrically conductive gasket in the groove to the second-interior surface.

14. A process of forming a concentric feed including an outer-conductive tube electrically connected to a base of an inner-conductive tube, the process comprising:

configuring the outer-conductive tube to include:

a side-port;

a first-edge surface;

a first-interior surface sharing an edge with and perpendicular to the first-edge surface;

a second-edge surface;

a second-interior surface sharing an edge with and perpendicular to the second-edge surface;

a third-edge surface; and a third-interior surface sharing an edge with and perpendicular to the third-edge surface, configuring the inner-conductive tube to include:

a base at a base-end of the inner-conductive tube, the base including a first lip protruding orthogonal to a first surface of the base, a second lip protruding orthogonal to a second surface of the base, and a third lip protruding orthogonal to a third surface of the base and a central-port centered on a central axis; and a main-body extending in an axial direction from the base; and positioning the outer-conductive tube to contact the inner-conductive tube at the base wherein the outer-conductive tube and the inner-conductive tube are co-aligned to the central axis.

15. The process of claim 14, further comprising:

forming a groove in the second lip; and inserting an electrically conductive gasket in the groove, wherein the process of positioning the outer-conductive tube to contact the inner-conductive tube comprises:

contacting the first-edge surface of the outer-conductive tube to the first surface of the base;

positioning the first-interior surface adjacent to the first lip;

contacting the second-edge surface of the outer-conductive tube to the second surface of the base;

positioning the second-interior surface adjacent to the second lip to contact the electrically conductive gasket in the groove to the second-interior surface;

contacting the third-edge surface of the outer-conductive tube to the third surface of the base; and positioning the third-interior surface adjacent to the third lip.

16. The concentric feed of claim 14, wherein configuring the inner-conductive tube further comprises the steps of:

forming an indent in the base, wherein the first lip is an interior surface of the indent and wherein the first surface is a flat-external-base surface in which the central-port is formed; and forming a groove in the base, and wherein positioning the outer-conductive tube to contact the inner-conductive tube further comprises the steps of:

inserting an electrically conductive gasket in the groove of the base;

positioning the first-interior surface of the outer-conductive tube adjacent to the interior surface of the indent in the base;

contacting the second-edge surface of the outer-conductive tube to the second surface of the base; and positioning the second-interior surface adjacent to the second lip to contact the electrically conductive gasket in the groove to the second-interior surface.

17. The concentric feed of claim 14, the process further comprising the step of laser welding the outer-conductive tube to the inner-conductive tube.

* * * * *